US012325106B2

(12) United States Patent
Huang

(10) Patent No.: US 12,325,106 B2
(45) Date of Patent: Jun. 10, 2025

(54) DEVICE FOR CONDITIONING CHEMICAL MECHANICAL POLISHING

(71) Applicant: TAIWAN SEMICONDUCTOR MANUFACTURING CO., LTD., Hsinchu (TW)

(72) Inventor: Chun-Hsi Huang, Hsinchu (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 1168 days.

(21) Appl. No.: 16/663,231

(22) Filed: Oct. 24, 2019

(65) Prior Publication Data

US 2020/0130139 A1 Apr. 30, 2020

Related U.S. Application Data

(60) Provisional application No. 62/753,916, filed on Oct. 31, 2018.

(51) Int. Cl.
*B24B 53/12* (2006.01)
*B24B 37/20* (2012.01)

(52) U.S. Cl.
CPC ..... *B24B 53/12* (2013.01); *B24B 37/20* (2013.01)

(58) Field of Classification Search
CPC ..... F16B 12/38; F16B 12/26; F16B 5/0642; B24B 53/017; B24B 45/006; B24B 53/12; B24B 53/02; B24B 37/16; B24B 37/14; B24B 41/047; B24B 37/015; B24B 37/12; B24B 55/02

(Continued)

(56) References Cited

U.S. PATENT DOCUMENTS 5,567,503 A * 10/1996 Sexton ..... B24D 3/30 428/323
5,931,724 A * 8/1999 Perlov ..... B24B 37/12 451/60

(Continued)

FOREIGN PATENT DOCUMENTS

CN 202180415 U 4/2012
CN 103707193 A 4/2014

(Continued)

OTHER PUBLICATIONS

Wang Xinting: "Design of Motorized Toys", Jan. 31, 2012, National Defense Industry Press.

(Continued)

*Primary Examiner* — Eric J Rosen
*Assistant Examiner* — Sharonda T Felton
(74) *Attorney, Agent, or Firm* — STUDEBAKER BRACKETT PLLC

(57) ABSTRACT

A conditioning device for conditioning a polishing pad used in chemical mechanical polishing includes a base having an opening and a conditioning disk removably attached to the base. The conditioning disk includes a conditioning portion disposed on a first surface of the base and a fitting portion removably fitted into or through the opening of the base. The fitting portion is fitted through or into the opening to base to prevent dislodging of the conditioning disk from the base during a process of conditioning a polishing pad for the chemical mechanical polishing process.

20 Claims, 15 Drawing Sheets

(58) Field of Classification Search
USPC ..... 451/56, 443
See application file for complete search history.

(56) References Cited

U.S. PATENT DOCUMENTS

| | | | | |
|---|---|---|---|---|
| 5,954,570 | A * | 9/1999 | Yano | B24B 53/12 451/285 |
| 6,142,859 | A * | 11/2000 | Ross | B24D 13/14 451/271 |
| 7,670,209 | B2 * | 3/2010 | Fujita | B24D 13/10 451/72 |
| 8,796,666 | B1 | 8/2014 | Huang et al. | |
| 9,093,530 | B2 | 7/2015 | Huang et al. | |
| 9,184,054 | B1 | 11/2015 | Huang et al. | |
| 9,256,123 | B2 | 2/2016 | Shih et al. | |
| 9,529,268 | B2 | 12/2016 | Chang et al. | |
| 9,548,303 | B2 | 1/2017 | Lee et al. | |
| 9,618,837 | B2 | 4/2017 | Lu et al. | |
| 9,869,928 | B2 | 1/2018 | Huang et al. | |
| 9,869,934 | B2 | 1/2018 | Huang et al. | |
| 9,869,939 | B2 | 1/2018 | Yu et al. | |
| 2002/0081952 | A1 * | 6/2002 | Fritz | B29C 65/0672 451/443 |
| 2005/0202760 | A1 * | 9/2005 | Palmgren | B24B 53/017 451/56 |
| 2010/0190417 | A1 * | 7/2010 | Watanabe | B24B 53/017 451/288 |
| 2012/0270483 | A1 * | 10/2012 | Bae | B24D 7/066 451/540 |

FOREIGN PATENT DOCUMENTS

| | | | |
|---|---|---|---|
| CN | 106078517 | A | 11/2016 |
| CN | 107078048 | A | 8/2017 |
| JP | 2000-114215 | A | 4/2000 |
| JP | 2004-001152 | A | 1/2004 |
| JP | 2015-150683 | A | 8/2015 |
| KR | 10-2005-0017418 | A | 2/2005 |
| TW | 527261 | B | 4/2003 |
| TW | 201446423 | A | 12/2014 |
| TW | I647070 | B | 1/2019 |
| WO | 00/53370 | A2 | 9/2000 |

OTHER PUBLICATIONS

Office Action issued in corresponding Chinese Patent Application No. 201911051685.1 dated Mar. 14, 2022.
English language machine translation of JP 2004-001152 previously cited in Information Disclosure Statement dated Jun. 18, 2020.

* cited by examiner

DEVICE FOR CONDITIONING CHEMICAL MECHANICAL POLISHING

CROSS-REFERENCE TO RELATED APPLICATION

The present application claims priority to and incorporates by reference U.S. Provisional Application 62/753,916 filed on Oct. 31, 2018 in its entirety.

BACKGROUND

Size of critical features in an integrated circuit (IC) has continually decreased, and the need to perform high resolution lithography processes grows. As a consequence, the depth of focus of the radiation used for lithography has also decreased. There is a need to control the precision of planarization of wafers at atomic scale. For example, typical depth-of-field requirements for 28 nm, 22 nm, 16 nm and 10 nm technology are approaching angstrom levels. These are, of course, merely examples and are not intended to be limiting.

Chemical mechanical polishing (CMP) is most commonly used during wafer fabrication to provide an atomically flat surface at the beginning of the lithography process. In addition, as lithography has evolved and complexity of lithography increased, other areas of use for CMP have developed. For example, lately, CMP is used to planarize shallow trenches by polishing metal layers such as aluminum, copper and tungsten, etc.

A typical CMP tool includes a rotating flat plate covered by a pad facing up. The wafer to be polished is placed on a carrier with the surface to be polished facing down. A chemical slurry is disposed on the pad and the wafer (i.e., the surface to be polished) is contacted with the pad. The flat plate and the carrier are rotated, typically in opposite directions, while the carrier is additionally oscillated. The relative motion between the pad and the wafer surface results in polishing of the wafer surface. The pad is typically made of a porous polymeric material with a pore size in a range from about 30-50 μm. During the CMP process, the pads are consumed and need to be conditioned periodically.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion.

DETAILED DESCRIPTION

Figure 1:
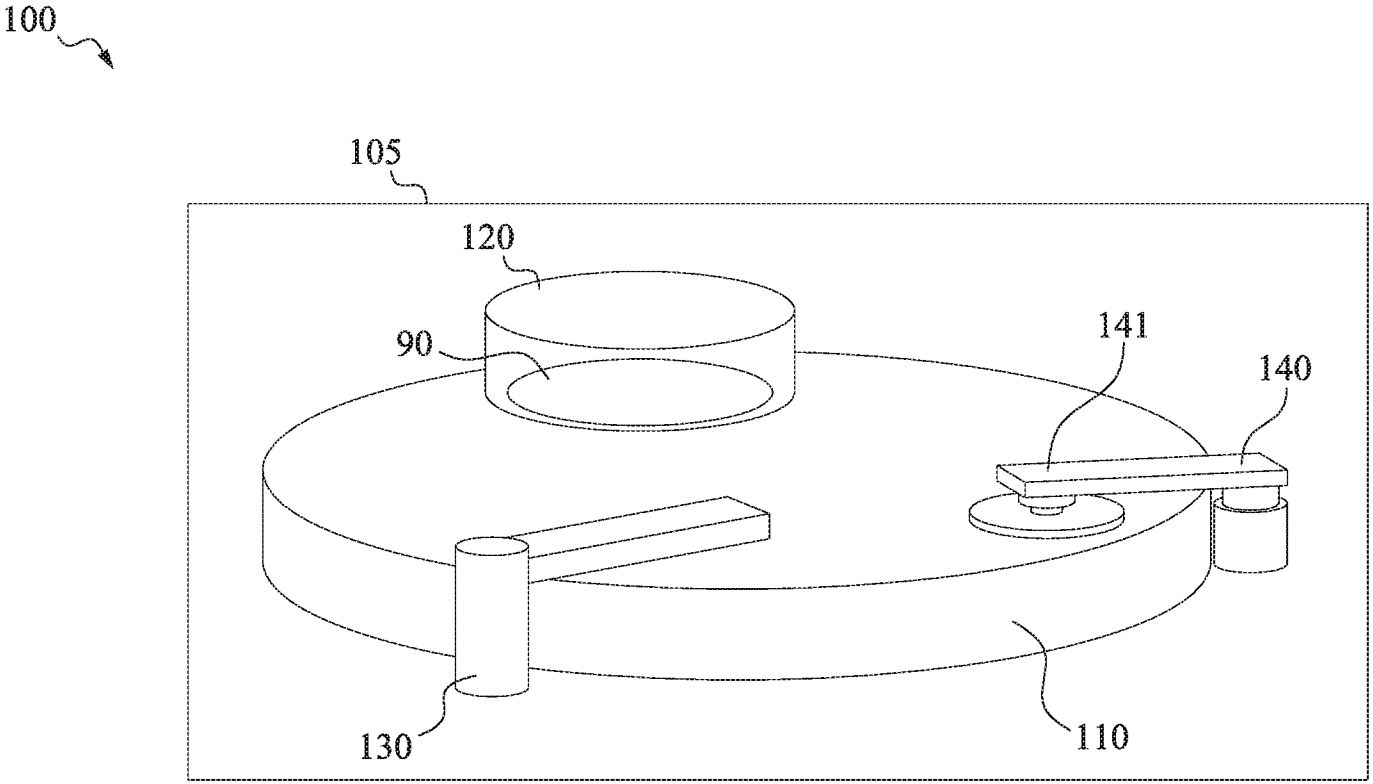
FIG. 1 is a schematic view of an apparatus for chemical mechanical polishing (CMP), constructed in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus/device may be otherwise oriented (rotated 90 degrees or at other orientations) and the spatially relative descriptors used herein may likewise be interpreted accordingly. In addition, the term "made of" may mean either "comprising" or "consisting of."

Apparatuses for polishing thin, flat semiconductor wafers are well known in the art. Such an apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or a wafer load station.

Chemical-mechanical polishing (CMP) apparatus has been employed in combination with a pneumatically actuated polishing head. The CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

The present disclosure generally relates to methods and apparatuses for monitoring and controlling the chemical mechanical polishing (CMP) process used in semiconductor manufacturing. Wafers are typically planarized using the CMP process which uses a polishing pad and a chemical slurry. The slurry is typically a colloid of a material that acts as a chemical etchant for etching the material at the top surface of the wafer. The polishing pad is rotated relative to the wafer while slurry is disposed so as to remove material and smooth any irregular topography. As the wafer is planarized, the polishing pad gets used, and needs to be conditioned periodically. The embodiments disclosed herein provide a device for conditioning the polishing pads.

FIG. 1 schematically illustrates an apparatus 100 for performing chemical mechanical polishing (CMP) on a wafer 90, in accordance with an embodiment of the present disclosure. In an embodiment, the apparatus 100 includes a chamber 105 enclosing a rotating platen 110 (e.g., a rotating table), a polishing head assembly 120, a chemical slurry supply system 130, and a pad conditioner 140 including a conditioning arm 141.

Figure 2:
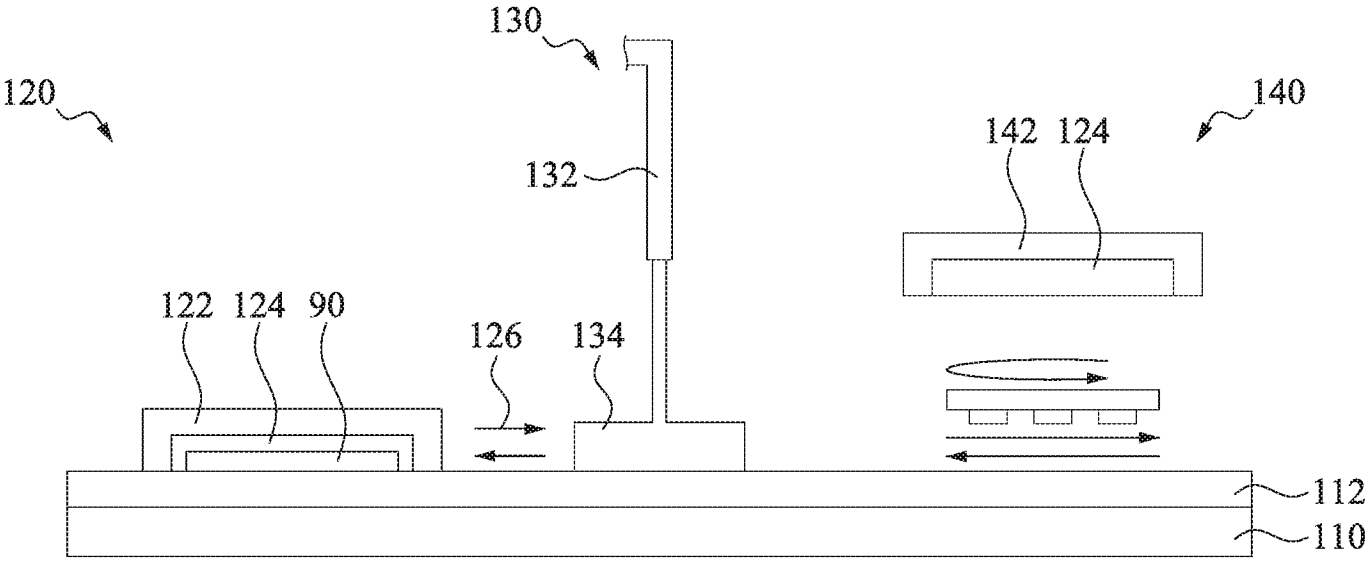
FIG. 2 schematically illustrates a cross-sectional view of the apparatus for chemical mechanical polishing (CMP), constructed according to an embodiment.

FIG. 2 schematically illustrates a cross-sectional view of the apparatus for chemical mechanical polishing (CMP), constructed according to an embodiment. As shown in FIG. 2, the platen 110 is connected to a motor (not shown) which rotates the platen 110 at a preselected rotational velocity. In an embodiment, the platen 110 is covered with a replaceable polishing pad 112 (interchangeably referred to herein as "the pad"). In some embodiments, the polishing pad 112 is a thin polymeric disc with a grooved surface, and can be porous or solid, depending on the application. Factors determining the material and physical properties of the pad 112 include the material to be polished (i.e., material at the wafer surface), and the desired roughness after polishing. The polishing pad 112 may have a pressure sensitive adhesive on the back so that the pad 112 adheres to the platen 110. During the polishing process, the polishing pad 112 may be wetted with a suitable lubricant material, depending on the type of material being polished (i.e., the material at the top surface of the wafer).

In an embodiment, the polishing head assembly 120 includes a head 122 and a carrier 124. The head 122 holds the carrier 124 which holds the wafer 90 to be polished. In some embodiments, the polishing head assembly 120 includes a displacement mechanism (not shown) to oscillate the head 122 sideways 126. In some embodiments, the head 122 may include a motor for rotating the wafer 90 relative to the platen 110. In some embodiments, the wafer 90 and the platen 110 are rotated in an asynchronous non-concentric pattern to provide a non-uniform relative motion between the platen 110 and the wafer 90. The non-uniformity of the relative motion facilitates uniform removal of material from the wafer surface by avoiding a repeated removal from the same spot. The polishing head assembly 120 applies a controlled downward pressure to the wafer 90 to hold the wafer 90 against the platen 110.

The slurry supply system 130 introduces a chemical slurry 134 (interchangeably referred to herein as "the slurry") of a suitable material to be used as an abrasive medium between the pad 112 and the wafer 90. In an embodiment, the slurry 134 is a colloid of abrasive particles dispersed in water with other chemicals such as rust inhibitors and bases to provide an alkaline pH. In some embodiments, the abrasive particles are of materials such as, for example, silica, ceria, and alumina. In an embodiment, the abrasive particles have a generally uniform shape and a narrow size distribution, with average particle size ranging from about 10 nm to about 100 nm or more depending on the application for which it is being used. In an embodiment, the slurry supply system 130 includes a storage system (not explicitly shown) and a conduit 132 for delivering the slurry 134 to the polishing pad 112 atop the platen 110. The rate of flow of the slurry 134 may be controlled based on the application.

In an embodiment, the pad conditioner 140 "conditions" the polishing pad 112 to provide uniform thickness and roughness across the entire area of the platen 110 by polishing the pad 112. Maintaining the thickness and roughness of the pad 112 prevents unwanted pressure points or warpage on the wafer 90 during the polishing process, and helps to maintain uniform thickness of the wafer 90.

A conditioning head 142 is mounted on the conditioning arm 141 which is extended over the top of the polishing pad 112 for making sweeping motion across the entire surface of the polishing pad 112. The polishing pad 112 is a consumable item used in a semiconductor wafer fabrication process. Under normal wafer fabrication conditions, the polishing pad is replaced after predetermined hours of usage. The polishing pad 112 may be hard, incompressible pad or soft pad. For oxide polishing, hard and stiffer pad is generally used to achieve planarity. Softer pad is generally used in other polishing processes to achieve improved uniformity and smooth surface. The hard pad and the soft pad may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing" wherein the surface of a polishing pad becomes smooth such that the pad no longer holds slurry in-between the fibers. This is a physical phenomenon on the pad surface not caused by any chemical reactions between the pad and the slurry. To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, re-open the pores, and thus forms micro-scratches in the surface of the pad for improved life time. The pad conditioning process can be carried out either during a polishing process, i.e. known as concurrent conditioning, or after a polishing process.

Embodiments disclosed herein provide the conditioning device 200 used for conditioning the polishing pad used in a CMP process. The conditioning device disclosed herein reduces wastage and expense, and requires lesser storage space. A comparative conditioning disk for use in pad conditioning is shown in FIGS. 3A-3B.

Figure 3A:
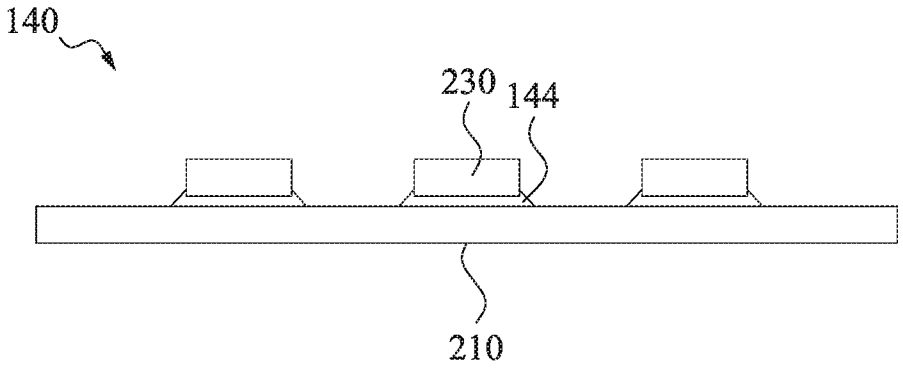
FIG. 3A schematically illustrates a cross-section of a typical conditioning device for use in pad conditioning.

FIG. 3A schematically illustrates a cross-section of a typical conditioning device for use in pad conditioning. While the pad conditioning process improves the consistency and lifetime of a polishing pad, a conventional conditioning disk is frequently not effective in conditioning a pad surface after repeated usage. The conventional conditioning device includes a base 210 and conditioning disks 220 disposed on the base 210. The conditioning disks 220 are adhered to the base 210 with a bonding adhesive 144 in some embodiments.

Figure 3C:
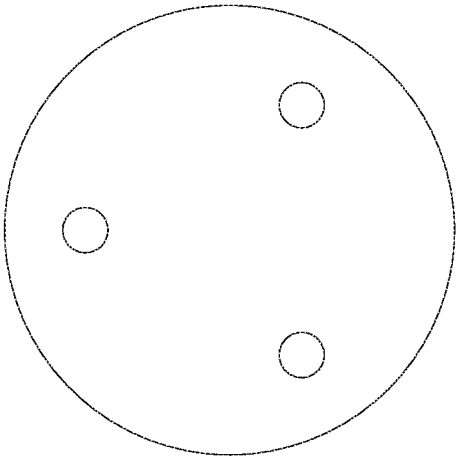
FIG. 3C schematically illustrates a top view of the typical conditioning device used for pad conditioning.
Figure 3B:
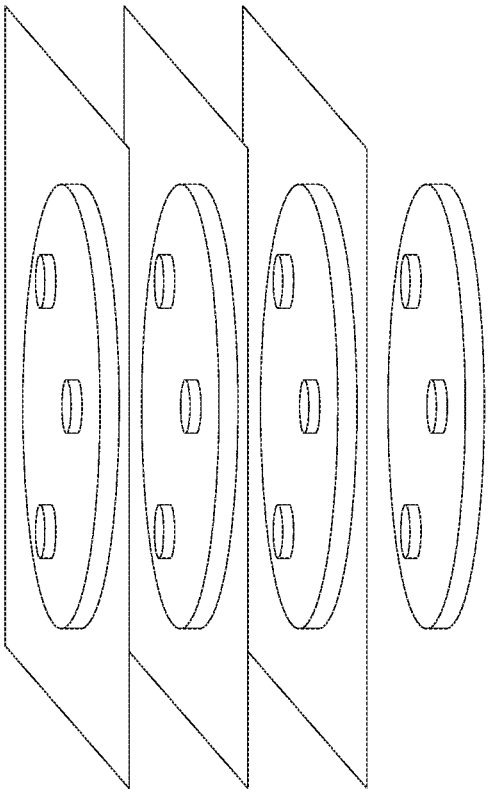
FIG. 3B shows image of the typical conditioning device used for pad conditioning during the shipping.

FIGS. 3B and 3C show exemplary images of a comparative conditioning device. FIG. 3B shows image of the typical conditioning device used for pad conditioning during a shipping or in a storage and FIG. 3C schematically illustrates a top view of the typical conditioning device. During the shipping of these conditioning devices, it is critical that the packages do not become damaged in any way. Damage to the conditioning device and/or a diamond conditioning film or the conditioning film tray may result in debris within the packaged conditioning device and, require the conditioning device and its conditioning film to be less effective for conditioning the polishing pad. Furthermore, damage to the tray, film or tray/film seal may cause a loss of the conditioning capability, resulting in rapid replacement of the conditioning device.

The conditioning devices are not necessarily uniformly damaged, but rather only portions of the conditioning device are damaged or reduced in thickness. In other words, it may not be necessary to replace the entire conditioning device prior to a subsequent conditioning process. Therefore, any unnecessary waste and/or additional expense can be reduced by replacing only a portion of the conditioning device that need to be replaced. However, the conditioning device shown in FIG. 3A does not allow for partial replacement, as the conditioning disk 220 cannot be removed from the base 210 because of the bonding adhesive. The embodiments disclosed herein enable the replacement of only for those conditioning disks that are required to be replaced.

Figure 4:
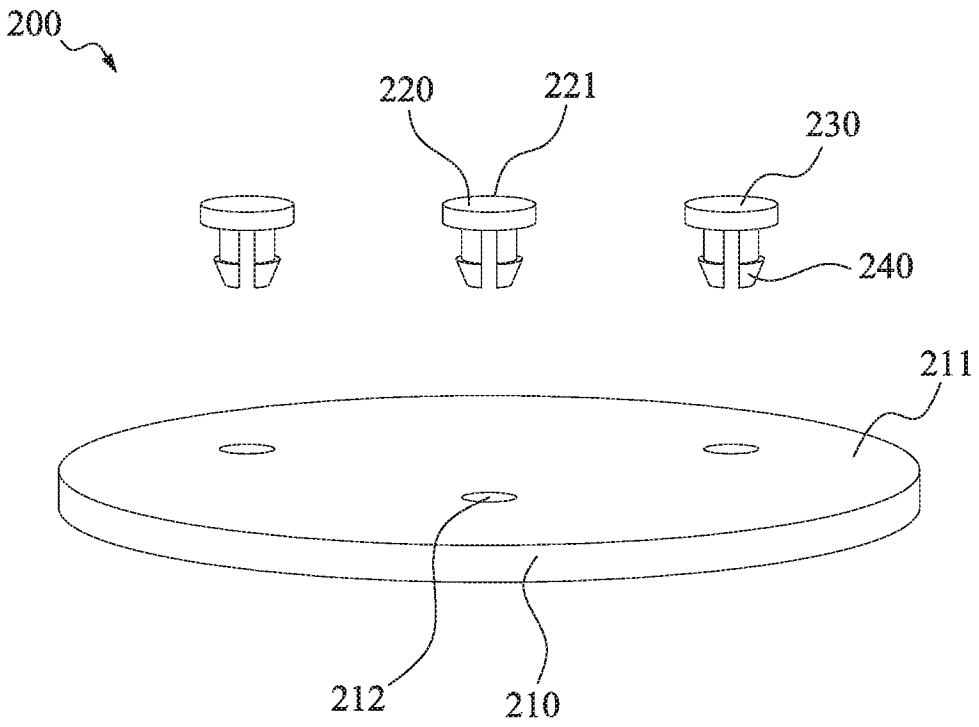
FIG. 4 is a schematic view of a conditioning device for conditioning a polishing pad used in chemical mechanical polishing constructed in accordance with some embodiments of the present disclosure.

FIG. 4 is a schematic view of a conditioning device 200 for conditioning a polishing pad used in chemical mechanical polishing constructed in accordance with some embodiments of the present disclosure. The conditioning device 200 includes a base 210 and a conditioning disk 220. The base 210 include a disk opening 212 by and/or through which the conditioning disk 220 is removably attached to the base 210. The conditioning disk 220 includes a conditioning portion 230 and a fitting portion 240. The conditioning portion 230 is configured to be disposed on a conditioning surface 211 of the base 210. The fitting portion 240 is configured to be fitted into or through the disk opening 212 of the base 210. The fitting portion 240 is to prevent dislodging of the conditioning disk 220 from the base 210 during a conditioning process of the polishing pad for the chemical mechanical polishing (CMP). In some embodiments, the conditioning disk 220 is made of a suitable metal such as stainless steel. The conditioning disk 220 includes a diameter ranging from about 1 mm to less than about 100 mm depending on (i) the diameter of the base 210, (ii) the diameter of each conditioning portion 230, and (iii) the number of conditioning portion 230 attached to the backside surface, or bottom surface, of the base 210.

The conditioning portion 230 further includes a conditioning film 221 including such as, for example, diamond, on a conditioning surface 211 of the base 210. By way of example and without limitation, the conditioning film 221 can be formed by chemical vapor deposition (CVD) at a thickness of about 0.1 mm to about 30 mm (e.g., 30 mm). In some embodiments, the conditioning film 221 defines the "working area" of the conditioning disk 220. That is, the area of the conditioning disk 220 that contacts the pad and "activates" (conditions) the top surface of the pad. The conditioning film 221 can have a nanocrystalline or microcrystalline microstructure, according to some embodiments. By way of example and without limitation, the size of the diamond microcrystals or nanocrystals in conditioning film 221 can range from about 1 μm to about 1000 μm.

Figure 5A:
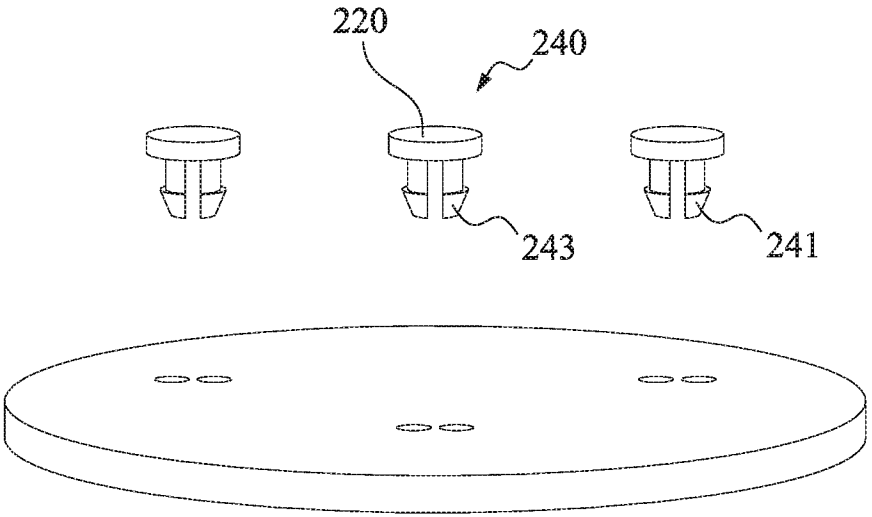
FIG. 5A is a schematic view of a conditioning device with a plurality of openings according to an embodiment of the present disclosure.
Figure 5A:
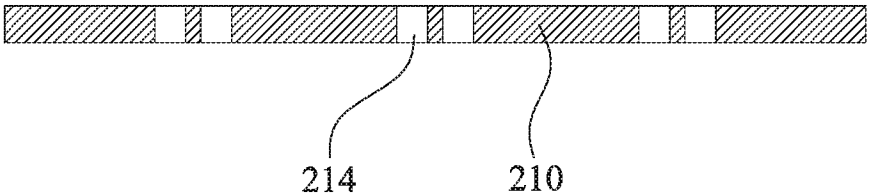

FIG. 5A is a schematic view of a conditioning device with a plurality of openings according to an embodiment of the present disclosure. In some embodiments, the base 210 includes a plurality of openings 214 to receive a portion of the fitting portion 240. The fitting portion 240 of the conditioning disk 220 includes a plurality of segmented fitting portions 241. In some embodiments, an elastic body 243 of the plurality of segmented fitting portions 241 is inserted into the through hole of the plurality of openings 214 located in the base 210. Then, the engaging claw of the elastic body 243 is engaged with the edge of the through hole thereof, thereby enabling a secure attachment of the conditioning disk 220 in the base 210.

Figure 5B:
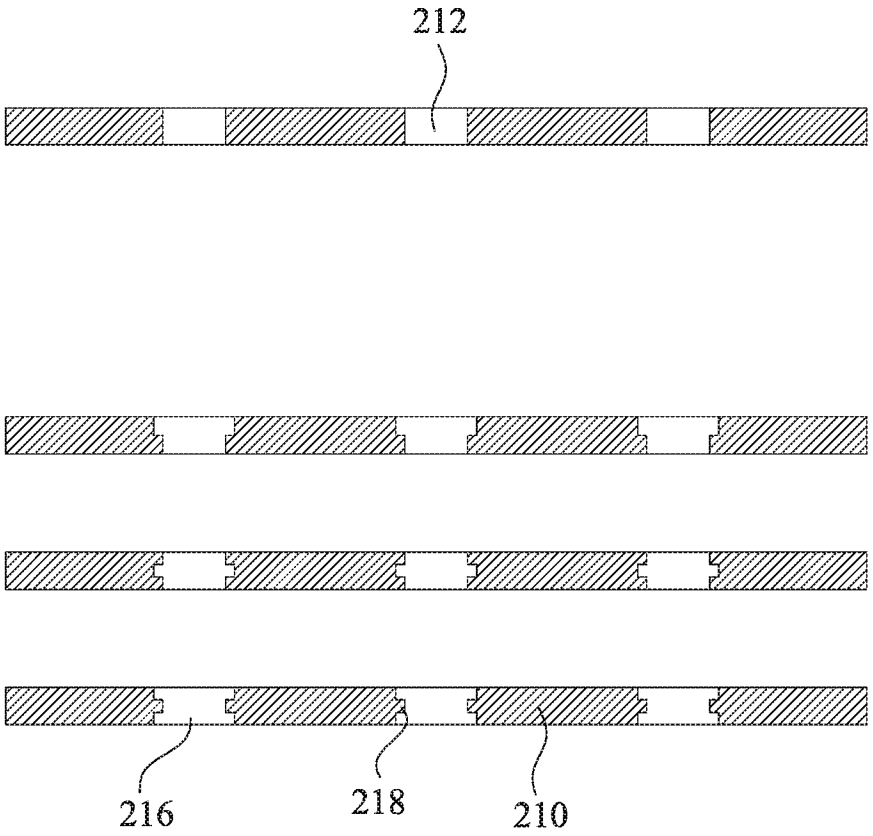
FIG. 5B is a schematic view of a conditioning device with a shaped opening according to an embodiment.

FIG. 5B is a schematic view of a conditioning device with a shaped opening 216 according to various embodiments of the present disclosure. In some embodiments, as shown in FIG. 5B, the base 210 includes the shaped opening 216 with a cross-sectional profile 218 such that the shaped opening 216 of the base 210 allows the fitting portion 240 of the conditioning disk 220 to be securely attached to the base 210. In some embodiments, cross-sectional profile 218 includes at least one selected from the "I"-shaped cross-sectional profile, "T"-shaped cross-sectional profile, or "+" shaped cross-sectional profile, as shown in FIG. 5B. However, it should be understood that this is merely an exemplary embodiment and that the present system may apply to any cross-sectional profiles without any limitation. For the sake of brevity of the present disclosure, not every example is included, but the present application contemplates any such embodiments.

Figure 6B:
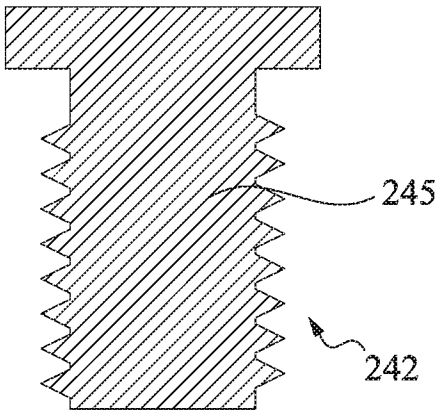
FIGS. 6A and 6B are schematic views of a conditioning device with a fastener in accordance with some embodiments of the present disclosure.
Figure 6A:
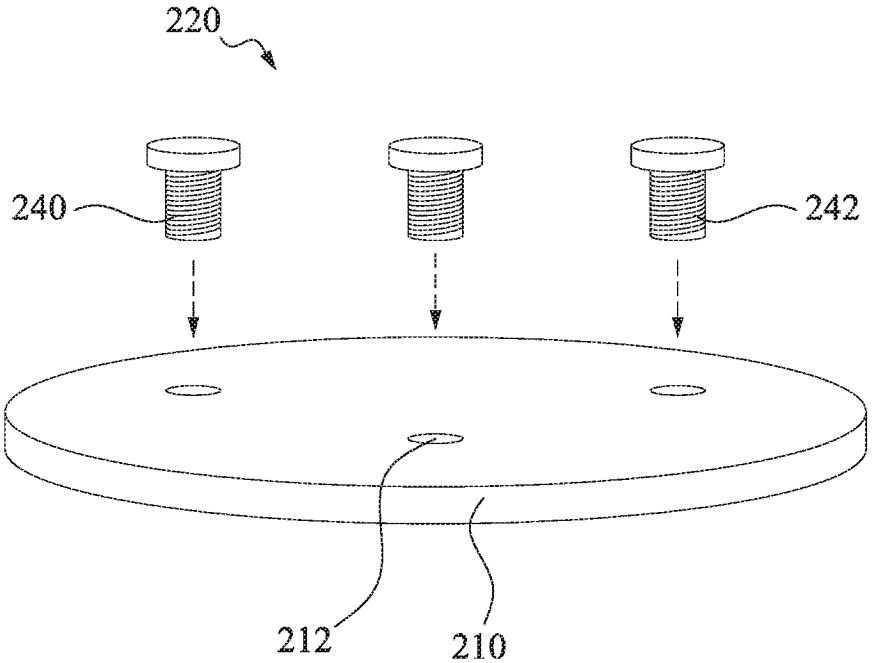

FIGS. 6A and 6B are schematic views of a conditioning device with a fastener according to various embodiments of the present disclosure. In some embodiments, the fitting portion 240 of the conditioning disk 220 includes a fastener 242 such as a screw or bolt to securely fasten the conditioning disk 220 in position to the base 210. In some embodiments, a threaded body 245 of the fastener 242 is inserted into the disk opening 212 located in the base 210. The engaging thread of the threaded body 245 is engaged with the edge of the through hole thereof, thereby enabling a secure attachment of the conditioning disk 220 to the base 210. In some embodiments, fastener 242 includes at least one selected from a screw, a rivet, and barb-type fitting. However, it should be understood that this is merely an exemplary embodiment and that the present system may apply to any fastener without any limitation. For the sake of brevity of the present disclosure, not every example is included, but the present application contemplates any such embodiments.

Figure 6D:
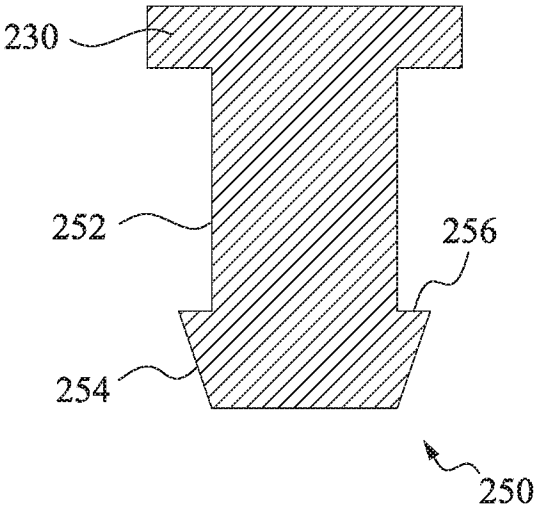
FIGS. 6C and 6D are schematic views of a conditioning device with a snap-fitting mechanism in accordance with some embodiments.
Figure 6C:
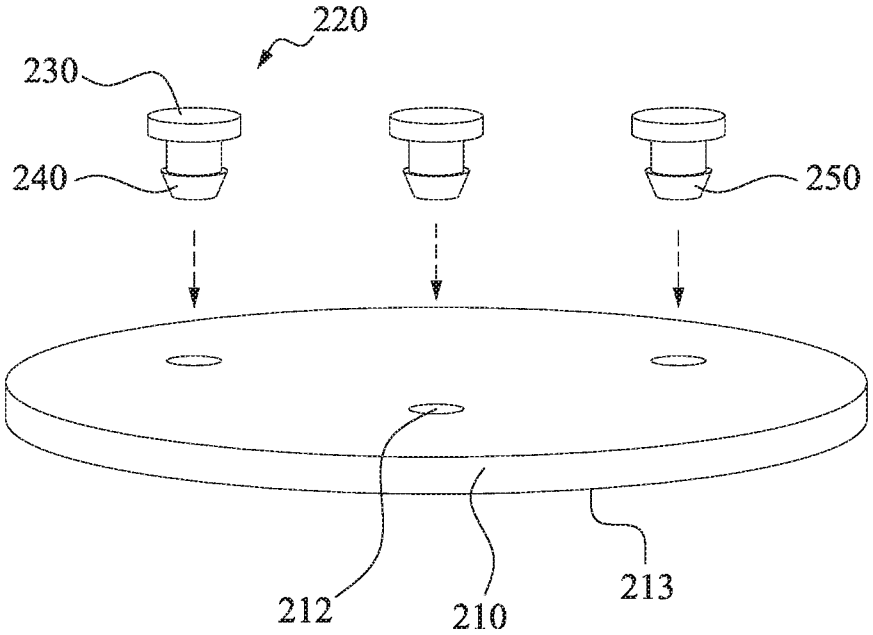

FIGS. 6C and 6D are schematic views of a conditioning device with a snap-fitting mechanism according to various embodiments of the present disclosure. In some embodiments, fitting portion 240 of the conditioning disk 220 includes a snap-fitting portion 250 to snap through the disk opening 212 of the base 210 and to engage snap-fitting portion 250 with a mounting side 213 of the base 210 through disk opening 212 thereof, thereby enabling quick and easy snap-fitting mechanism with a secured positioning of the conditioning disk 220 to the base 210. The snap-fitting portion 250 includes an extending portion 252 that extends away from the conditioning portion 230 to an anchoring portion 254 located at a far end of the extending portion 252. An inclined portion 254 of the snap-fitting portion 250 allows easy pass through the disk opening 212 of the base 210. The anchoring portion 256 of the snap-fitting portion 250 engages the snap-fitting portion 250 with the mounting side 213 of the base 210 and securely mount the conditioning disk 220 to the base 210. In some embodiments, the snap-fitting portion 250 is made of a polymeric material such as nylon or polycarbonate. In some embodiments, the snap-fitting portion 250 is made of an elastic material to achieve a flexible structure to enable a removal of the conditioning disk 220 from the base 210 when a replacement is needed. Examples of the elastic material forming the snap-fitting portion 250 include general crosslinked rubber materials such as silicone rubber, chloroprene rubber, EPDM, NBR, natural rubber, and fluororubber. In some embodiments, some examples of the silicone rubber include (meth) acryloyloxy group-containing polysiloxane, vinyl polysiloxane, mercaptoalkyl group-containing polysiloxane, and the like.

Figure 7A:
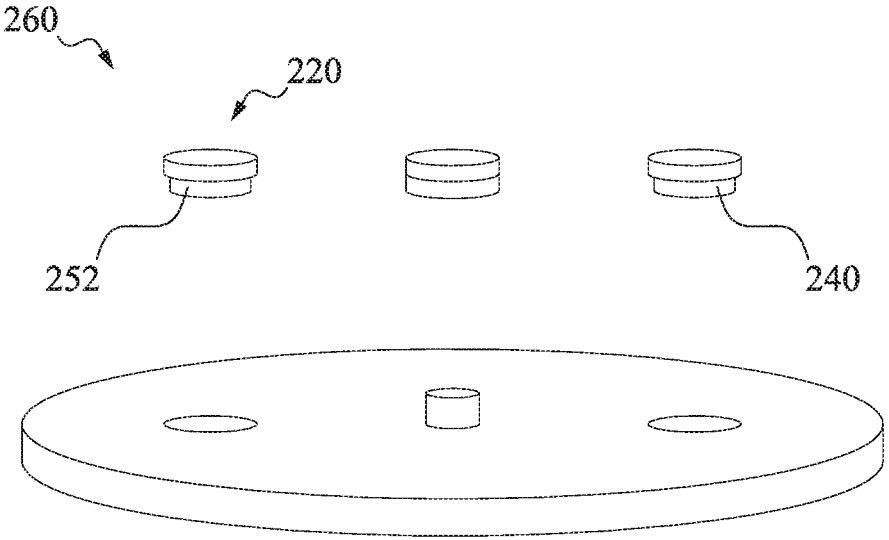
FIGS. 7A and 7B are schematic views of a conditioning device with a magnet in accordance with some embodiments.
Figure 7B:
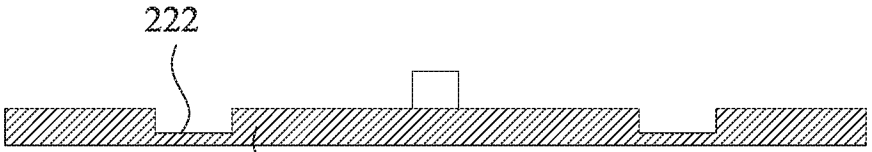

FIGS. 7A and 7B are schematic views of a conditioning device with a magnet according to various embodiments of the present disclosure. In some embodiments, as shown in FIGS. 7A and 7B, the fitting portion 240 utilize a magnetic snap lock 260. In some embodiments, the magnetic snap lock 260 of the fitting portion 240 includes a protruding portion 252 and the base 210 has a recessed portion 222. The protruding portion 252 and the recessed portion 222 cooperate with each other to define a locking position. In some embodiments, the protruding portion 252 is located in the conditioning disk 220 and the recessed portion 222 is located in the base 210. In an alternative embodiment, the protruding portion 252 is located in the base 210 and the recessed portion 222 is located in the base conditioning disk 220. In some embodiments, the protruding portion 252 of the conditioning disk 220 includes a magnetic material. In an alternative embodiment, the recessed portion 222 includes a magnetic material. However, it should be understood that this is merely an exemplary embodiment and that the present system may apply to any location, shape of the magnet without any limitation. For the sake of brevity of the present disclosure, not every example is included, but the present application contemplates any such embodiments.

Figure 7C:
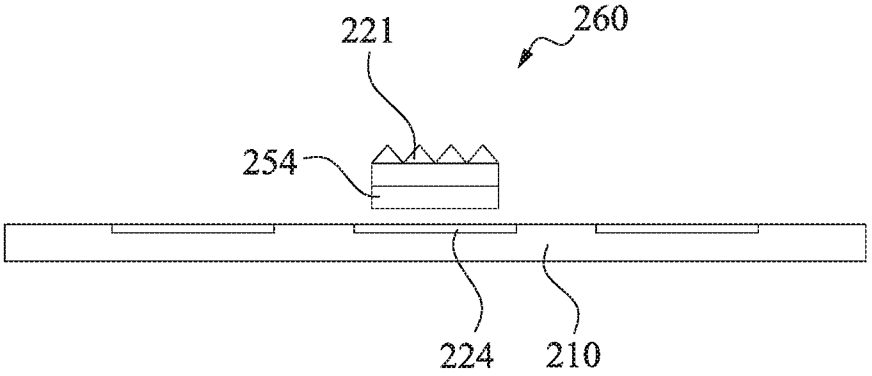
FIG. 7C is schematic view of a conditioning device with a magnetic portion on a flat surface of the base.

FIG. 7C is schematic view of a conditioning device with a magnetic portion on a flat surface of the base 210 according to various embodiments of the present disclosure. In some embodiments, as shown in FIG. 7C, the magnetic snap lock 260 of the fitting portion 240 includes a magnetic portion 254 and a corresponding ferromagnetic portion 224. The magnetic portion 254 and the corresponding ferromagnetic portion 224 cooperate with each other to define a locking position. In some embodiments, the magnetic portion 254 is located in the conditioning disk 220 (including the conditioning film 221) and the corresponding ferromagnetic portion 224 is located in the base 210. In an alternative embodiment, the magnetic portion 254 is located in the base 210 and the corresponding ferromagnetic portion 224 is located in the base conditioning disk 220.

Figure 8:
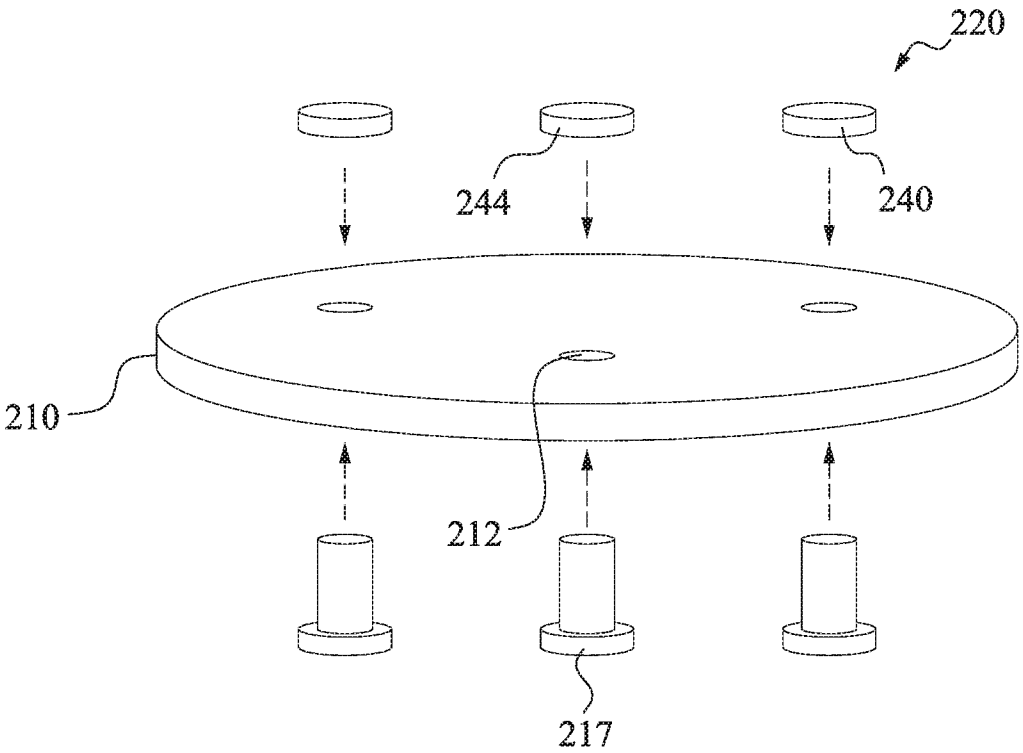
FIG. 8 is schematic view of a conditioning device with a receiving portion disposed on the conditioning disk.

FIG. 8 is schematic view of a conditioning device with a receiving portion 244 disposed on the conditioning disk 220 according to various embodiments of the present disclosure. In some embodiments, the fitting portion 240 of the conditioning disk 220 includes the receiving portion 244 to receive a mating fastener 217 and securely fasten the conditioning disk 220 to the base 210 by the mating fastener 217. In some embodiments, the receiving portion 244 of the conditioning disk 220 engages with the disk opening 212 located in the base 210 to mate with the mating fastener 217 such that the conditioning disk 220 and the base 210 are securely locked at a defined position. In some embodiments, mating fastener 217 includes at least one selected from a screw, a rivet, and barb-type fitting. In some embodiments, the receiving portion 244 is a recessed area of the conditioning disk 220. The receiving portion 244 cooperate with mating fastener 217 to define a locking position. However, it should be understood that this is merely an exemplary embodiment and that the present system may apply to any fastener without any limitation. For the sake of brevity of the present disclosure, not every example is included, but the present application contemplates any such embodiments.

Figure 9A:
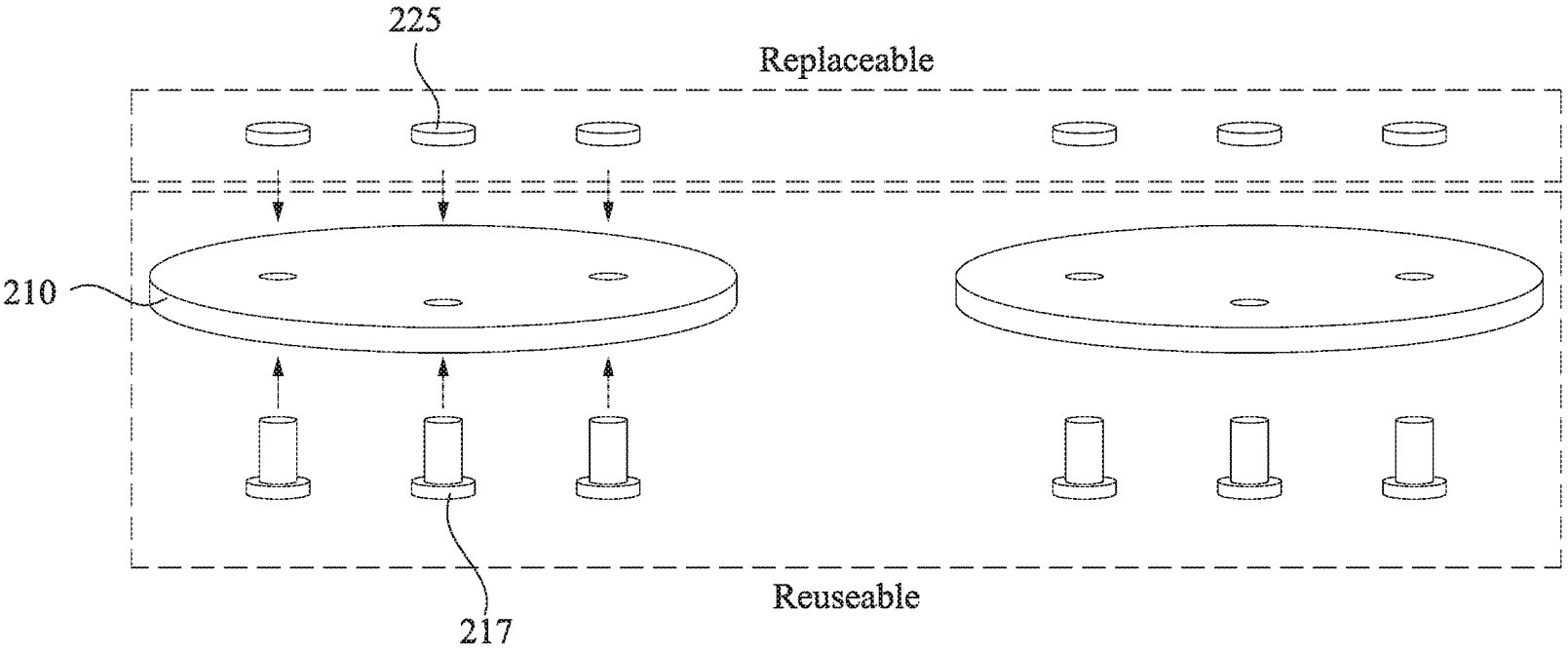
FIG. 9A is schematic view of a conditioning device with a replaceable conditioning disk and a reusable base assembly.

FIG. 9A is schematic view of a conditioning device with a replaceable conditioning disk and a reusable base assembly according to various embodiments of the present disclosure. Because the conditioning disk 220 of the conditioning device 200 is removably attached to the base 210, the conditioning disk 220 is readily replaceable the replaceable conditioning disk 229 allowing a reuse of the remaining elements of the conditioning device 200 such as, for example, the reusable base assembly 219 including the base 210 and the mating fastener 217, without replacing the entire conditioning device 200 used for conditioning the polishing pad used in the chemical mechanical polishing (CMP) process. While the preferred embodiment is intended for use as a conditioning device for conditioning a polishing pad used in chemical mechanical polishing, the conditioning disk 225 could be used for a variety of different applications, depending upon the type of conditioning media used, for conditioning pads.

Figure 9B:
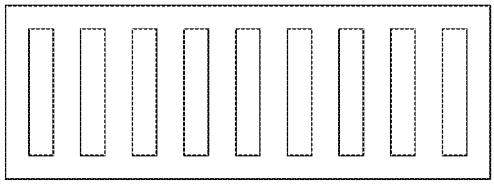
FIG. 9B schematically illustrates stacking of the conditioning devices during the storage in accordance with various embodiments of the present disclosure.
Figure 9B:
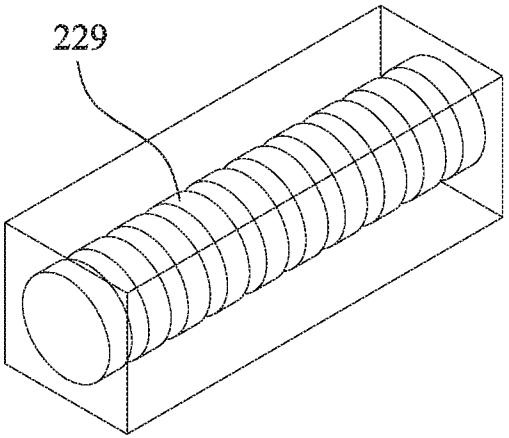

FIG. 9B schematically illustrates stacking of the conditioning devices during the storage in accordance with various embodiments of the present disclosure. Because the conditioning disks are substantially smaller than the entire conditioning devices, the space needed to for storage of replacement conditioning disks is substantially smaller. In some embodiments, the replaceable conditioning disks 229 are stackable. Therefore, the use of conditioning device including the replaceable conditioning disk 229 in accordance with various embodiments of the present disclosure not only reduce wastage and expense, but also reduce the storage space needed for storing replacement conditioning devices.

Figure 10:
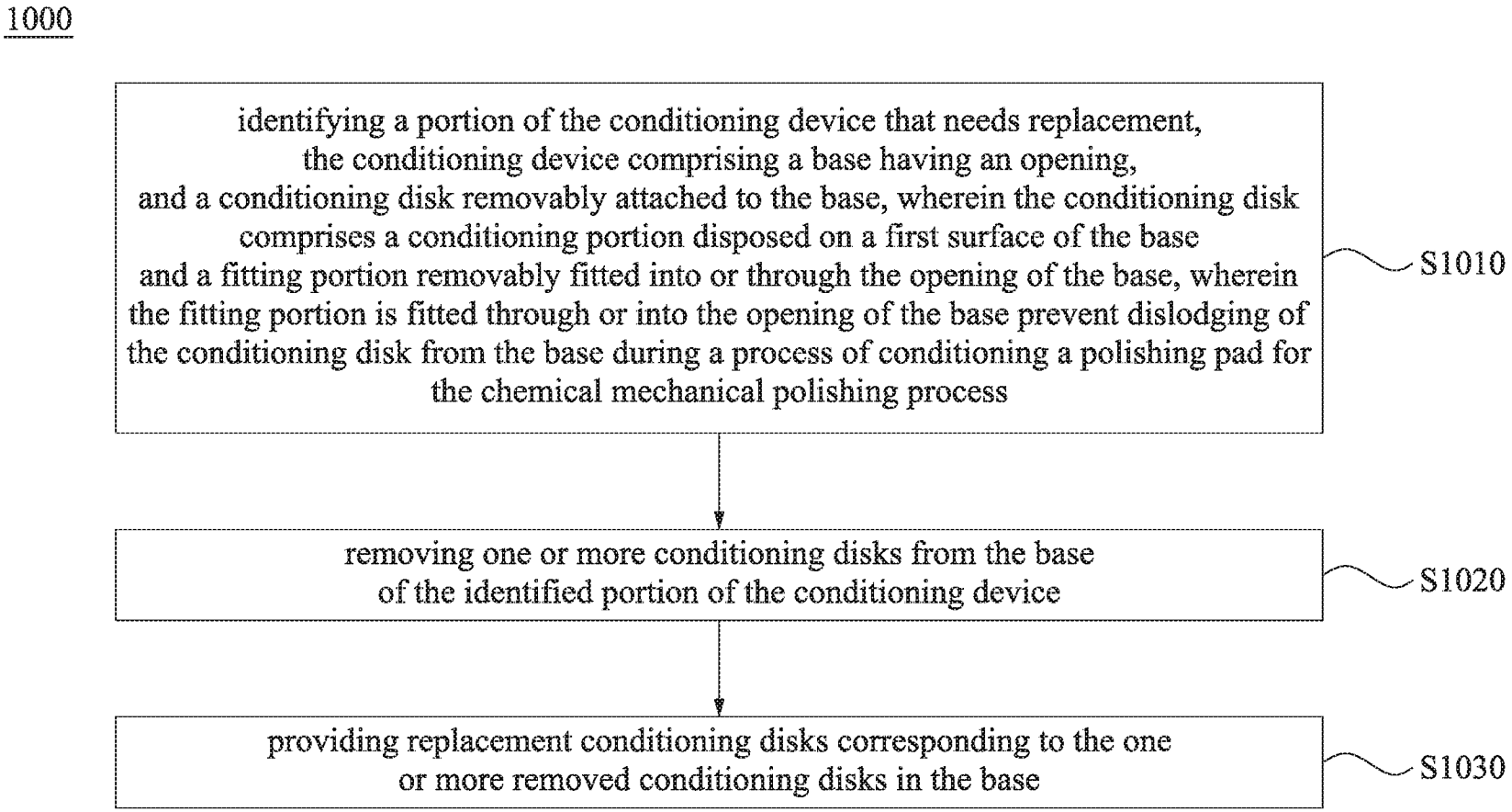
FIG. 10 illustrates a flow chart of a method 1000 of conditioning a polishing pad for chemical mechanical polishing in accordance with an embodiment of the present disclosure.

FIG. 10 illustrates a flow chart of a method 1000 of conditioning a polishing pad for chemical mechanical polishing in accordance with an embodiment of the present disclosure. The method includes, at S 1010, identifying a portion of the conditioning device that needs replacement. The conditioning device comprises a base having an opening, and a conditioning disk removably attached to the base. The conditioning disk comprises a conditioning portion disposed on a first surface of the base and a fitting portion removably fitted into or through the opening of the base. The fitting portion is fitted through or into the opening to base to prevent dislodging of the conditioning disk from the base during a process of conditioning a polishing pad for the chemical mechanical polishing process. After identifying the portion of the conditioning device that needs replacement, the method includes, at S 1020, removing one or more conditioning disks from the base from the identified portion. Subsequently, at 1030, the method includes providing replacement conditioning disks corresponding to the one or more removed conditioning disks in the base.

It will be understood that not all advantages have been necessarily discussed herein, no particular advantage is required for all embodiments or examples, and other embodiments or examples may offer different advantages.

According to one aspect of the present disclosure, a conditioning device for conditioning a polishing pad used in chemical mechanical polishing includes a base having an opening and a conditioning disk removably attached to the base. The conditioning disk includes a conditioning portion and a fitting portion. The conditioning portion is disposed on a conditioning surface of the base. The fitting portion is fitted into or through the opening of the base. The fitting portion is to prevent dislodging of the conditioning disk from the base during a conditioning process of the polishing pad for the chemical mechanical polishing. In some embodiments, the base further includes a plurality of openings to receive a portion of the fitting portion. In some embodiments, the base further includes a shaped opening with a profile selected from at least one of "I"-shaped cross-sectional profile, "T"-shaped cross-sectional profile, or "+" shaped cross-sectional profile. In some embodiments, the fitting portion of the conditioning disk further includes a fastener. In such embodiments, the fastener comprises at least one selected from a screw, a rivet, and a barb. In some embodiments, the fitting portion is fitted to the base by a snap-fitting mechanism. In such embodiments, the snap-fitting mechanism is made of an elastic material. In some embodiments, the fitting portion is fitted to the base by a magnet snap lock. In such embodiments, the magnet snap lock includes a protruding portion and a recessed portion. In some embodiments, the magnet snap lock includes magnetic portion and a corresponding ferromagnetic portion. In some embodiments, the fitting portion of the conditioning disk is configured to receive a mating fastener. In such embodiments, the mating fastener comprises at least one selected from a screw, a rivet, and a barb. In some embodiments, the conditioning disk further includes a replacement conditioning disk.

It should be understood that while term "conditioning disk" is used herein, the shape of the "disk" is not particularly limited and can be, for example, circular, quadrangular, triangular, hexagonal, or any other convex shape.

According to another aspect of the present disclosure, a method of conditioning a polishing pad for chemical mechanical polishing includes identifying a portion of the conditioning device that needs replacement. The conditioning device comprises a base having an opening, and a conditioning disk removably attached to the base. The conditioning disk comprises a conditioning portion disposed on a first surface of the base and a fitting portion removably fitted into or through the opening of the base. The fitting portion is fitted through or into the opening to base to prevent dislodging of the conditioning disk from the base during a process of conditioning a polishing pad for the chemical mechanical polishing process. After identifying the portion of the conditioning device that needs replacement, the method removes one or more conditioning disks from the base from the identified portion. Subsequently, the method provides replacement conditioning disks corresponding to the one or more removed conditioning disks in the base. In some embodiments, the method provides a reusable base assembly including the base and a reusable fastener. In some embodiments, the method provides a reusable base assembly including the base and a reusable fastener.

According to other aspects of the present disclosure, a conditioning assembly for conditioning a polishing pad used in chemical mechanical polishing includes a base, a conditioning disk, and a replacement conditioning disk. The base has an opening and the conditioning disk removably attached to the base. The conditioning disk includes a conditioning portion and a fitting portion. The conditioning portion is disposed on a conditioning surface of the base. The fitting portion is fitted into or through the opening of the base. The fitting portion is to prevent dislodging of the conditioning disk from the base during a conditioning process of the polishing pad for the chemical mechanical polishing. In some embodiments, the conditioning assembly further comprises a reusable base assembly including the base and a reusable fastener. In some embodiments, the replacement conditioning disk is stackable. In some embodiments, the base further includes a shaped opening with a profile selected from at least one of "I"-shaped cross-sectional profile, "T"-shaped cross-sectional profile, or "+" shaped cross-sectional profile.

The foregoing outlines features of several embodiments or examples so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments or examples introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A chemical mechanical polishing (CMP) apparatus, comprising:

a polishing pad; and a conditioning device for conditioning the polishing pad, wherein:

the conditioning device includes:

a base having an opening; and a conditioning disk removably attached to the base, the conditioning disk includes:

a conditioning portion disposed on a conditioning surface of the base, the conditioning surface facing the polishing pad; and a fitting portion fitted into or through the opening of the base, the fitting portion comprising:

a magnetic snap lock connection to the opening, the magnetic snap lock connection including a protruding portion and a recessed portion receiving the protruding portion, the conditioning disk including the protruding portion and the opening including the recessed portion, wherein the fitting portion prevents dislodging of the conditioning disk from the base during a conditioning process of the polishing pad for the chemical mechanical polishing.

2. The CMP apparatus of claim 1, wherein the conditioning disk includes a magnetic portion, and the base includes a ferromagnetic portion.

3. The CMP apparatus of claim 1, wherein the magnetic snap lock connection includes a magnetic portion and a corresponding ferromagnetic portion.

4. The CMP apparatus of claim 1, wherein the conditioning device further includes a replacement conditioning disk.

5. A method of conditioning a polishing pad for chemical mechanical polishing, the method comprising:

conditioning the polishing pad with a conditioning device, the conditioning device comprising a base having a plurality of openings, and a plurality of conditioning disks removably attached to the base, wherein each of the plurality of conditioning disks comprises a conditioning portion disposed on a first surface of the base, which faces the polishing pad, and a fitting portion removably fitted into a corresponding opening of the plurality of openings of the base, the fitting portion comprising:

a magnetic snap lock connection to the opening, the magnetic snap lock connection including a protruding portion and a recessed portion receiving the protruding portion, the conditioning disk including the protruding portion and the opening including the recessed portion, wherein the conditioning disk contacts the polishing pad during a process of conditioning the polishing pad;

identifying a portion of the conditioning device that needs replacement, removing one or more conditioning disks from the base of the identified portion of the conditioning device; and providing one or more replacement conditioning disks corresponding to the one or more removed conditioning disks in the base.

6. A conditioning assembly for conditioning a polishing pad used in chemical mechanical polishing, the assembly comprising:

a base having an opening;

a conditioning disk removably attached to the base, the conditioning disk comprising:

a conditioning portion disposed on a conditioning surface of the base which faces the polishing pad and configured to contact the polishing pad, and a fitting portion fitted into the opening of the base, the fitting portion comprising:

a magnetic snap lock connection to the opening, the magnetic snap lock connection including a protruding portion and a recessed portion receiving the protruding portion, the conditioning disk including the protruding portion and the opening including the recessed portion, wherein the fitting portion prevents dislodging of the conditioning disk from the base during a conditioning process of the polishing pad for the chemical mechanical polishing; and a replacement conditioning disk.

7. The conditioning assembly of claim 6, wherein the replacement conditioning disk is stackable.

8. The method of claim 5, further comprising inserting a fitting portion of the one or more replacement conditioning disks into an opening of the plurality of openings.

9. The conditioning assembly of claim 6, wherein the conditioning disk includes a magnetic portion, and the base includes a ferromagnetic portion.

10. The CMP apparatus of claim 1, further comprising a conditioning arm configured to move the conditioning device across the polishing pad during conditioning of the polishing pad.

11. The CMP apparatus of claim 1, further comprising a platen supporting the polishing pad and configured to rotate the polishing pad.

12. The CMP apparatus of claim 11 further comprising a conduit configured to deliver a slurry to the polishing pad.

13. The method of claim 5, wherein the conditioning the polishing pad with the conditioning device comprises sweeping the conditioning device across a surface of the polishing pad.

14. The method of claim 5, wherein the plurality of conditioning disks have diameters ranging from 1 mm to 100 mm.

15. The method of claim 5, wherein the conditioning portion comprises a conditioning film.

16. The method of claim 15, wherein the conditioning film comprises diamond microcrystals or diamond nanocrystals.

17. The conditioning assembly of claim 6, wherein the conditioning portion comprises a conditioning film configured to contact the polishing pad.

18. The conditioning assembly of claim 17, wherein the conditioning film comprises diamond microcrystals.

19. The conditioning assembly of claim 18, wherein the diamond microcrystals have sizes ranging from 1 μm to 1000 μm.

20. The conditioning assembly of claim 6, wherein the conditioning disk has a diameter ranging from 1 mm to 100 mm.

* * * * *